US008986074B2

(12) United States Patent
Eliason

(10) Patent No.: US 8,986,074 B2
(45) Date of Patent: Mar. 24, 2015

(54) FLUID CONTROL CIRCUIT FOR WET ABRASIVE BLASTING

(75) Inventor: Keith Eliason, Virginia Beach, VA (US)

(73) Assignee: GRACO Minnesota Inc., Minneapolis, MN (US)

( * ) Notice: Subject to any disclaimer, the term of this patent is extended or adjusted under 35 U.S.C. 154(b) by 373 days.

(21) Appl. No.: 13/482,644

(22) Filed: May 29, 2012

(65) Prior Publication Data

US 2013/0324016 A1 Dec. 5, 2013

(51) Int. Cl.
*B24C 7/00* (2006.01)

(52) U.S. Cl.
CPC ..... *B24C 7/0038* (2013.01)
USPC ..... 451/90; 137/599.03; 451/99; 451/101; 451/446

(58) Field of Classification Search
CPC ..... B24B 57/02; B24C 7/007; B05B 7/16
USPC ..... 137/599.03; 239/336, 379; 451/90, 99, 451/100, 101, 446
See application file for complete search history.

(56) References Cited

U.S. PATENT DOCUMENTS

| | | | | |
|---|---|---|---|---|
| 2,729,917 | A * | 1/1956 | Gregory | 451/90 |
| 5,230,185 | A * | 7/1993 | Kirschner et al. | 451/38 |
| 5,261,454 | A * | 11/1993 | Pavlica et al. | 137/625.48 |
| 5,407,379 | A * | 4/1995 | Shank et al. | 451/99 |
| 7,549,911 | B2 * | 6/2009 | Nguyen | 451/101 |
| 2002/0052175 | A1 * | 5/2002 | Pettit et al. | 451/60 |

* cited by examiner

*Primary Examiner* — Timothy V Eley
(74) *Attorney, Agent, or Firm* — Bernard G Pike; Pike IP Law, PLLC

(57) ABSTRACT

Wet abrasive systems typically have a combination of equipment, controls, and piping systems that allow various fluid flows to be controlled in order to provide the various operations. A fluid control circuit is used to provide fluid to the correct locations for each operation. A fluid control circuit has a multiport selector valve. The selector valve allows selective fluid communication between the fluid inlet and either a first fluid outlet or a second fluid outlet. A first piping system is in fluid communication with the first fluid outlet and a second piping system is in fluid communication with the second fluid outlet. The fluid control circuit may also have jumper piping system between the first piping system and the second piping system. The combination of a multiport selector and the piping systems provide a convenient blast system to operate.

21 Claims, 9 Drawing Sheets

FLUID CONTROL CIRCUIT FOR WET ABRASIVE BLASTING

FIELD OF THE INVENTION

The invention is directed to a fluid control circuit. An embodiment of the fluid control circuit is for wet abrasive blasting systems used for cleaning, preparing surfaces, removing coatings, and/or other abrasive blasting operations. Embodiments of the fluid control circuit provide the ability and enable a user, among other things, to more easily obtain a consistent slurry flow which results in a more efficient blasting operation as compared to conventional wet blasting systems. Embodiments of the invention provides an accurate, simple, and intuitive control of the fluid supply system, which is used to pressurize the blast pot, control the metering of the wet abrasive, and/or allow for pressure washing (without media). In certain embodiments of the fluid control circuit, all these operations may be controlled through one selector valve.

BACKGROUND

To remove the paint, dirt or other surface coating from a substrate such as a surface to be painted or cleaned, a blasting system is desirable and effective. There are a variety of blasting processes for these purposes, including, but not limited to, water blasting, dry abrasive blasting, and wet abrasive blasting. In certain applications, abrasive blasting systems are able to efficiently clean or remove a coating without damaging the underlying metal or other substrate, although in other applications, a certain degree of surface roughening may be desired.

The use of dry abrasive blasting with particles, such as those used in conventional sand blasting, may result in excessive surface roughness and other damage to the substrate. Typical blast particles are hard and abrasive in order to increase the efficiency of the blasting operation but may, therefore, result in damage to the substrate. Soft recyclable blast particles are sometimes substituted to avoid surface damage. These recyclable blast particles include, but are not limited to, agricultural products such as crushed walnut shells, crushed pistachio shells, corn husks, and rice hulls. Plastic particles are sometimes used to reduce substrate surface damage but may also result in a reduction in efficiency of the blasting operation.

Wet abrasive systems have been used to also control and reduce surface damage. Wet abrasive systems combine the benefits of water blasting systems with dry abrasive blasting systems. In wet abrasive blasting, the fluid can encapsulate particles of the abrasive media to simultaneously add mass to the abrasive and buffer the impact of the abrasive against the substrate to reduce potential surface damage, but still effectively strip or clean the surface while also reducing the dust produced by dry blasting. However, wet abrasive systems require efficient mixing of the slurry with a gas stream to produce a consistent blast stream comprising a three-phase mixture of fluid, solid abrasive, and gas. If the mixing of slurry and pressurized gas is not well controlled, the blasting process is less efficient and, therefore, the benefits of the wet abrasive system are not fully realized.

There is a need for a wet abrasive system that is easier to control in order for the benefits of a wet abrasive system to be more fully realized. In the past, the control has been overly complicated and required extensive training before an operator became fully proficient. Even then, there remained the possibility of operator error because multiple selector valves have at least nine different positions which could be selected (only one being the correct position); therefore, there were eight possible erroneous positions for any one function.

SUMMARY

Wet abrasive systems comprise a combination of equipment, controls, and piping systems that allow the fluid flow to be controlled in order to provide the various operations desired to be performed to remove the paint, dirt or other surface coatings from a substrate, such as a surface to be painted or cleaned. A fluid control circuit includes piping systems for directing the fluid to different locations or equipment of the wet abrasive blasting system for the various operations. For example, a fluid control circuit is configured to provide control over the fluid flow for the various operations of a wet abrasive blasting system. The fluid control circuit allows a user to switch from one operation to the next depending on the stage of the abrasive blasting operation including, but not limited to, filling the blast pot, blasting the substrate with a three phase flow of solid blasting media, a fluid, and compressed gas, rinsing the substrate with the fluid, blowing down or drying the substrate with compressed gas, and rinsing the equipment and general work area.

An embodiment of the fluid control circuit comprises a multiport selector valve comprising a fluid inlet, and at least two fluid outlets including a first fluid outlet and a second fluid outlet. The selector valve allows selective fluid communication between the fluid inlet and either the first fluid outlet or the second fluid outlet. A first piping system is in fluid communication with the first fluid outlet and a second piping system is in fluid communication with the second fluid outlet to direct the fluid flow to different locations in the wet abrasive blasting system. In one embodiment, the fluid control circuit comprises a jumper piping system between the first piping system and the second piping system. The jumper piping system may comprise a check valve, wherein the check valve allows flow from the first piping system to the second piping system but prevents flow from the second piping system to the first piping system.

In a specific embodiment, the first piping system provides fluid communication between the first fluid outlet and the bottom of a blast pot and the second piping system provides fluid communication between the second fluid outlet and the top of the blast pot.

In another embodiment, the fluid control circuit for a wet abrasive blasting system may comprise a third fluid outlet in fluid communication with a third piping system in fluid communication with a rinse hose and nozzle.

An embodiment of the wet abrasive blasting system comprising a blast pot, the blast pot comprising a top inlet and a bottom inlet, a fluid control circuit, the fluid control circuit comprising a multiport selector valve comprising a fluid inlet, a first fluid outlet, and a second fluid outlet, a source of pressurized fluid in fluid communication with the fluid inlet, a first piping system in fluid communication with the first fluid outlet and the bottom inlet, a second piping system in fluid communication with the second fluid outlet and the top inlet, and jumper piping system between the first piping system and the second piping system, the jumper piping system comprising a check valve. The check valve may allow flow from the first piping system to the second piping system but prevents low from the second piping system to the first piping system.

The terminology used herein is for the purpose of describing particular embodiments only, and is not intended to be limiting of the invention. As used herein, the term "and/or"

includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of components, parts, techniques and steps are disclosed. Each of these has individual benefit and each can also be used in conjunction with one or more, or in some cases, all of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

DESCRIPTION OF EMBODIMENTS OF THE INVENTION

Embodiments of the fluid control system comprise a unique piping system that allow simple and effective control of the fluid supply system for the various operations of a wet abrasive blasting system.

Wet abrasive systems comprise a combination of equipment, controls, and piping systems that allow the fluid flow to be controlled in order to provide various operations desired to be performed to remove the paint, dirt or other surface coatings from a substrate such as a surface to be painted or cleaned. A fluid control circuit includes piping systems for directing the fluid to different locations or equipment of the wet abrasive blasting system for the various operations. For example, a fluid control circuit is configured to provide control over the fluid flow for the various operations of a wet abrasive blasting system. The fluid control circuit allows a user to switch from one operation to another depending on the desired operation of the abrasive blasting including, but not limited to, filling the blast pot, blasting the substrate with a three phase flow of solid blasting media, a fluid, and compressed gas, rinsing the substrate with the fluid, blowing down or drying the substrate with compressed gas, and rinsing the equipment and general work area.

Figure 3:
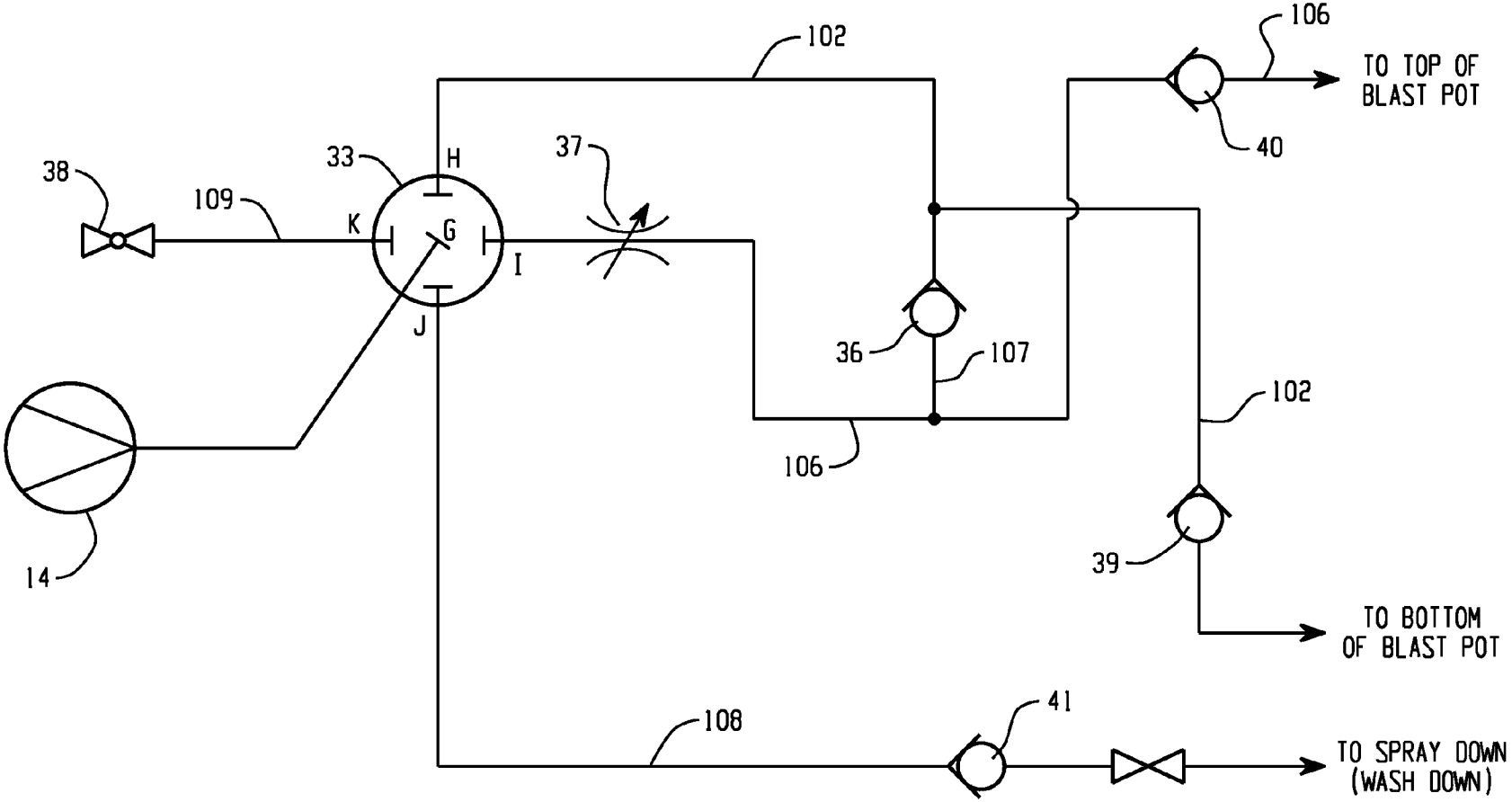
FIG. 3 is a schematic of an embodiment of a fluid control circuit of a wet abrasive blasting system.

An embodiment of the fluid control circuit comprises a multiport selector valve comprising a fluid inlet, and at least two fluid outlets including a first fluid outlet and a second fluid outlet. The selector valve allows selective fluid communication between the fluid inlet and either the first fluid outlet or the second fluid outlet. A first piping system is in fluid communication with the first fluid outlet and the bottom of the blast pot and a second piping system in fluid communication with the second fluid outlet and the top of the blast pot. In one embodiment, the fluid control circuit comprises a jumper piping system between the first ping system and the second piping system, wherein the jumper piping system comprises a check valve, wherein the check valve allows flow from the first piping system to the second piping system but prevents flow from the second piping system to the first piping system. This system allows fluid flow to be directed to both the top and bottom of the blast pot when the selector valve is positioned for fluid communication with the first fluid outlet for filling and flushing but only directs fluid flow to the top of the blast pot with the selector valve is positioned for fluid communication with the second fluid outlet for blasting. In a specific embodiment of the fluid control system, the second piping system comprises a flow control or metering valve. In one such embodiment, the jumper piping connects to the second piping system downstream of the metering valve as shown in FIG. 3.

In another embodiment, the fluid control circuit for a wet abrasive blasting system may comprise a rinse outlet in fluid communication with a rinse piping system in fluid communication with a rinse hose and nozzle.

As such, an embodiment of the wet abrasive blasting system comprising a blast pot, the blast pot comprising a top inlet and a bottom inlet, a fluid control circuit, the fluid control circuit comprising a multiport selector valve comprising a fluid inlet, a first fluid outlet, and a second fluid outlet, a source of pressurized fluid in fluid communication with the fluid inlet, a first piping system in fluid communication with the first fluid outlet and the bottom pot inlet, a second piping system in fluid communication with the second fluid outlet and the top pot inlet, and a jumper piping system between the first piping system and the second piping system, the jumper piping system comprising a check valve. The check valve may allow flow from the first piping system to the second piping system but prevents flow from the second piping system to the first piping system.

A further embodiment of the fluid control circuit comprises a multiport selector valve comprising a fluid inlet, and at least two fluid outlets including a first fluid outlet and a second fluid outlet. The selector valve allows selective fluid communication between the fluid inlet and one of the first fluid outlet and the second fluid outlet. A first piping system is in fluid communication with the first fluid outlet and a second piping system in fluid communication with the second fluid outlet to direct the fluid flow to different locations in the wet abrasive blasting system. In one embodiment, the fluid control circuit comprises a jumper piping system between the first piping system and the second piping system. The jumper piping system may comprise a check valve, wherein the check valve allows flow from the first piping system to the second piping system but prevents flow from the second piping system to the first piping system.

In another embodiment, the fluid control circuit for a wet abrasive blasting system may comprise rinse fluid outlet in fluid communication with rinse piping system in fluid communication with a rinse hose and nozzle.

An embodiment of the wet abrasive blasting system comprising a blast pot, the blast pot comprising a top inlet and a bottom inlet, a fluid control circuit, the fluid control circuit comprising a multiport selector valve comprising a fluid inlet, a first fluid outlet, and a second fluid outlet, a source of pressurized fluid in fluid communication with the fluid inlet, a first piping system in fluid communication with the first fluid outlet and the bottom pot inlet, a second piping system in fluid communication with the second fluid outlet and the top pot inlet, and jumper piping system between the first piping system and the second piping system, the jumper piping system comprising a check valve. The check valve may allow flow from the first piping system to the second piping system but prevents flow from the second piping system to the first piping system.

In one embodiment, a fluid control circuit for a wet abrasive blasting system comprises piping systems including four check valves (one check valve in jumper piping between a first piping system and a second piping system, one check valve prior to the inlet at the top of the blast pot, one check valve prior to the inlet at the bottom of the blast pot and one in the wash down piping system), one quick coupler, two ball valves, and one precision metering valve, all of which are in fluid communication with a four-way selector valve. This unique combination produces the capability to perform at least eight different operations of a wet abrasive blasting system. The eight functions include fill, flush, expel media from abrasive hose, expel media from the internal plumbing, blast, power wash, rinse, and air dry. In this embodiment, the eight functions may be controlled by positioning the single selector valve to one of only four positions (and is some cases, opening/closing another valve or coupling/uncoupling piping), this substantially reducing the possibility of operator-error. The fluid piping systems and fluid control circuit allows for greater control and consistency of the mixing of the gas and slurry, resulting in a more consistent flow of the three-phase blasting stream and a more efficient wet blasting process.

As used herein, "pipe" and "piping" shall mean any fluid containment device used to convey liquid or gas, such as a tube, hose, duct, pipe, or other similar structure. The pipe may have any cross-sectional shape, including rectangular, square, circular, or other shape. The flow area of the pipe is defined by its internal cross-sectional area.

As used herein, "piping system" shall mean pipe, and other components used to connect one part of a system to another. The other components may include, but are not limited to, valves, check valves, elbows, tees, reducers, regulators, connectors, gauges or gauge connectors, flow or temperature sensors, pressure gauges, and control valves.

As used herein, "fluid" or "fluids" are liquids. Preferably the fluids are substantially incompressible fluids, such as water.

Figure 1:
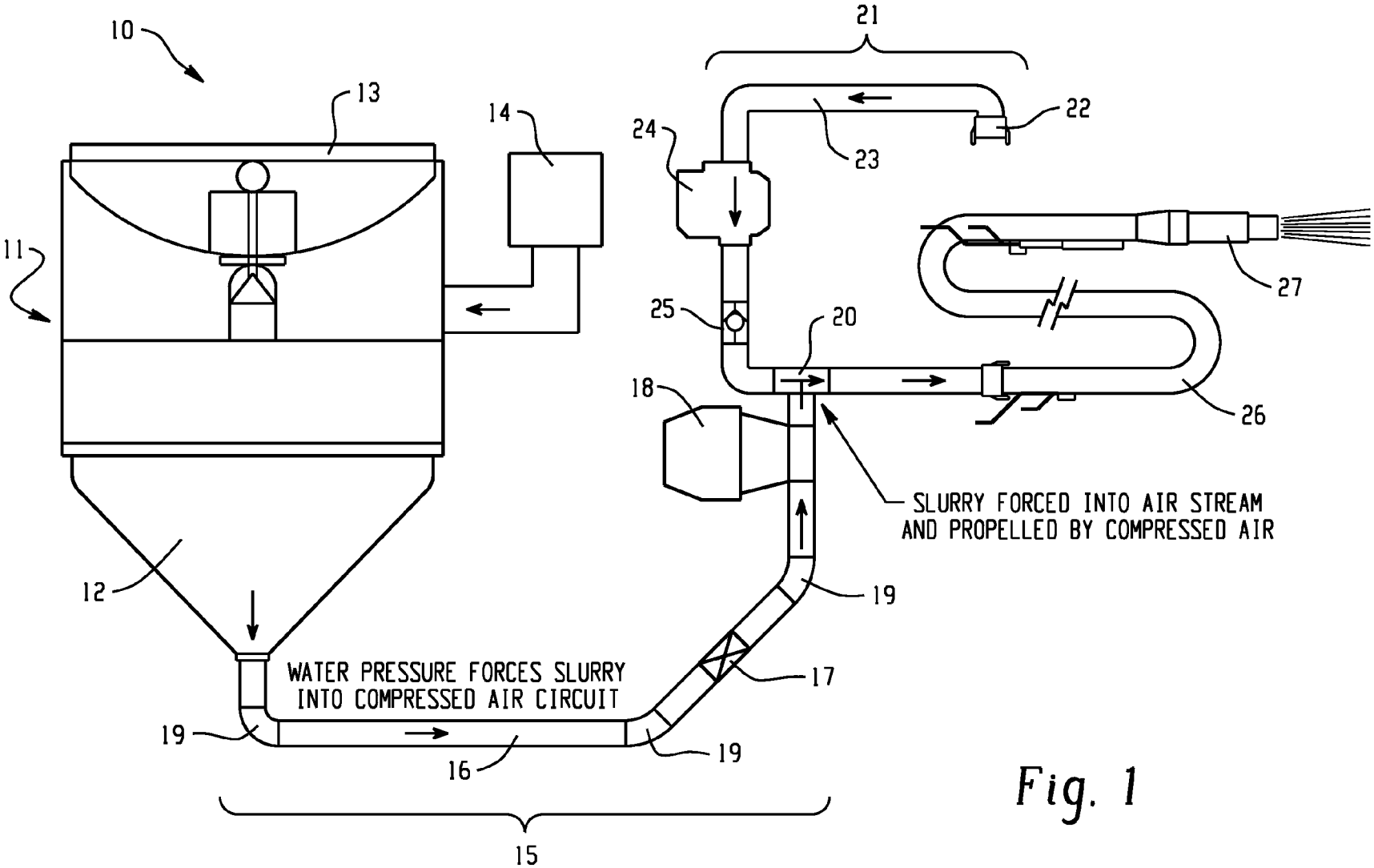
FIG. 1 is a general schematic drawing of a wet abrasive blasting system.

Typically as shown in FIG. 1, the flurry piping system 15 connects a blast pot 11 comprising the slurry to a slurry/gas mixer. In certain embodiments of the wet abrasive blasting system, the blast pot 11 contains a mixture of a solid particulate and a fluid (hereinafter "slurry"), and the fluid being under pressure in the blast pot 11 causes the slurry to be conveyed through the slurry piping system 15 at a desired flow rate from the blast pot 11 to the mixer 20. The pressurized gas piping system 21 is connected to a source of pressurized gas in order that the gas may be conveyed through the pressurized gas piping system 21 to the slurry/gas mixer 20 and is capable of conveying the desired flow rate of pressurized gas to the mixer 20. The three-phase blasting system exits the mixer 20 in the blast hose 26 to the blast nozzle 27.

Typically, the gas will be air and the fluid will be water, but other gases and fluids may be used. In addition, additives may be combined with the fluid or the gas, as desired, such as, but not limited to, to prevent flash rusting or to keep the liquid from freezing. The fluid is mixed with an abrasive media in the blast pot to form the slurry.

The abrasive media of the slurry may be any desired non-floating particulate matter capable of being transferred as slurry through the system. For example, the abrasive media may include media in the range of United States Standard Sieve Screen Size 100μ~10μ. The media and fluid are mixed into the blast pot, the ratio is variable as long as the slurry may be pushed through the slurry piping system fairly evenly and consistently. The cone shape of the bottom of the vessel and the fact that the media is heavier than the fluid causes the slurry to funnel into a hose or pipe that connects the blast pot to the input piping of the mixer.

The slurry piping system 15 and/or the pressurized gas piping system 21 may comprise pipe and other components as defined above. The size of the piping system depends on the size and capacity of the wet abrasive blasting system. Larger piping is needed to make the greater flow rate of larger systems.

An embodiment of a wet abrasive system 10 is depicted in FIG. 1. This embodiment comprises a blast pot 11. The blast pot 11 comprises a conical bottom 12 with a slurry exit 19 positioned at the lower end of the conical bottom 12. Such a blast pot 11 is advantageous for use with solid particulate or media that is heavier than the fluid, typically water, and which will not significantly rust or absorb a significant amount of the fluid, to be used in the blasting operation. Media such as sponge, untreated baking soda, crushed walnut shells, ground corn cob, and plastics have densities less than water and will float and/or absorb water. Such media may be used in a blast pot with an exit at the top of the blast pot, such as a conical top, for example. Blast pots of other configurations may also be used in the wet abrasive blasting systems, such as pots with flat or elliptical bottoms, or pots with tops or bottoms of other desired shapes.

The blast pot may further be comprised of a bung (pop-up), valve, flanged top, or other sealing mechanism that allows the blast pot to be purged of gas and pressurized by a source of pressurized fluid, such as a pump 14 or other source of pressurized fluid. Thus, the system may also include a blast pot similar to conventional dry-blasting, however, unlike conventional dry-blasting, the vessel is pressurized by a fluid, such as water, and there is substantially now air in the vessel during the blasting operation. Air trapped in the blast pot may result in pressure fluctuations because air is compressible, while water is substantially incompressible. The pump 14 shown in FIG. 1 is an air-operated pump. An air-operated pump may be convenient for use in wet abrasive systems as it may be operated from the same compressed air used to connect to the pressurized gas piping. However, the fluid pump may be powered by any source, such as electricity, for example. The media and fluid are mixed into the blast pot and the slurry ratio is determined by the size and weight of the individual particle. The desired slurry ratio depends on the blasting operation to be performed and the material of the substrate to be cleaned or stripped, as well as other factors such as the composition of the coating being removed. The cone-shaped bottom of the blast pot and the fact that the media is typically heavier than water causes the slurry to funnel into a hose or pipe that connects the blast pot to the input piping of the control panel. In this manner, the slurry may be pumped or pushed into the mixer to be combined with the pressurized air to form the abrasive spray. The abrasive spray is a combination of solid and liquid (from the slurry) and gas (from the pressurized gas source).

The wet abrasive blasting system 10 of FIG. 1 further comprises a slurry piping system 15 connecting the blasting pot 11 to the mixer 20. The slurry piping system 15 comprises pipe 16 and other components, including elbows 19 (in this embodiment both 90-degree elbows and 45-degree elbows are used), a manual shut-off valve 17, and an air operated shut-off valve 18. In one embodiment, the components have a similar internal flow area and thus are capable of supplying a consistent slurry pressure to the mixer during operation without resulting in significant cavitation or other pressure fluctuations. Other embodiments of the slurry piping system of the wet abrasive blasting system may or may not include these components and/or may include other components.

The wet abrasive blasting system 10 of FIG. 1 further comprises a pressurized gas piping system 21. In this embodiment, the pressurized gas piping system 21 comprises a compressed air connector 22 capable of connecting the gas piping system 21 to a source of pressurized gas such as, but not limited to, an air compressor or a pressurized tank, for example. The pressurized gas system 21 further comprises pipe 23, a pressure regulator 24, and a check valve 25. Other embodiments of the pressurized gas system of the wet abrasive system may or may not include these components and may or may not include other components.

A check valve in the air supply piping system provides back-flow protection to prevent slurry entering into the gas piping system. A check valve in any of the piping systems may be, but is not limited to, a flapper check valve, a weighted check valve, or a spring-loaded check valve, for example. Preferably, in certain embodiments, the check valve may have a cracking force of approximately 2 psi or a cracking force of greater than 2 psi. Further, to mitigate the risk of slurry entering the check valve and preventing the valve from closing and/or to assist slurry from being cleared from the check valve, the check valve may further be installed in a vertical position with the flow of the pressurized air in a downward direction. Further, the check valve may be installed in a position above the mixer. In contrast, in some conventional wet abrasive piping systems, the check valve is installed in a horizontal position. The horizontal position can contribute to filling and blocking the gas piping system with slurry.

To properly mix with the pressurized air, the slurry may be forced into the control panel or mixer at a force substantially equal to or greater than the force of the compressed air (the back pressure) as it passes through the slurry piping system and across the connection point of the slurry's piping into the mixer with the compressed air on its way to and through the blast hose 26 and the blast nozzle 27.

To create a consistent flow of slurry, the blast pot typically may be maintained at a pressure in the range from approximately 40 psi to approximately 140 psi or greater. A fluid pump is used to fully fill the blast pot with fluid, which already contains media. A venting process then removes substantially all of the air. Once the air is expelled, a sealing valve or bung is used to seal the blast pot, which is not substantially free of compressible gas. As the fluid pump continues to pump, fluid pressure will develop in the blast pot. The pump flow maintains the pressure in the blast pot and during operation forces the slurry into the mixer via the slurry piping system. The slurry piping system may be comprised of a manually operated ball valve, which allows the pressure in the vessel to be isolated from the control panel during the fill process. The ball valve is also used for clean-out purposes (providing the ability to safely reuse the media), and for wash-down purposes, which may be some of the added features to a working wet abrasive blasting system.

The driving force of the slurry through the spray nozzle of the wet abrasive blast system may be provided by a high-volume (40~900 CFM, for example) air compressor attached to the pressurized piping system. The pressure at which the compressed air is delivered to the mixer may be controlled by an air regulator designed to handle the volume of air being supplied by the compressor.

As previously discussed, the regulated air may be plumbed through a vertical check-valve with a cracking force of approximately 2 psi. The check valve is designed to be in the vertical position and, in some embodiments, positioned at least two inches above the height of where the slurry and air are mixed. Such an arrangement effectively blocks feed-back of slurry from getting into the air regulator and air control circuitry.

An air-controlled or electrically controlled shut-off valve may also be incorporated in the slurry piping system so the operator has the ability to simultaneously turn off the pressurized air supply and shut-off the slurry valve by means of a "dead man" switch at the blast nozzle or from a remote location. This action prevents slurry from being forced up into the pressurized air piping system (while not blasting) due to the fluid pressure's force in the blast pot.

In operation, the compressed air "powers through" the slurry being forced into the air/slurry stream. It is this action that causes the slurry to be "picked up" and propelled through the piping, the blast hose, and the nozzle. The mixture of compressed air, fluid, and media is accelerated by the action of the nozzle and becomes the working blast force used for cleaning, stripping, and removing unwanted coatings, linings, or rust.

Propulsion is effectively enhanced due to the fluid mixed with the media (slurry). The fluid serves to encapsulate the media which then aids the compressed air in the transport of the media and also serves as a dust suppressant when the media is blasted out of the nozzle and onto the substrate. The fluid mixed with the media (slurry) also serves the purpose of "lubricating" the interior of the blast hose so that the media can travel more efficiently in a "stream" rather than travelling dry through the blast hose, as is done in dry blasting systems.

In one embodiment, the wet abrasive blasting system comprises a vertical check valve located more than two inches above the entry height of the slurry into the blast stream. This design takes advantage of gravity and space to help reduce the possibility of slurry back-feeding into the pressurized air piping system. Although other wet-blast systems exist, the majority of these systems inject water at the nozzle, thus losing many of the effective features of this design. One primary example being the fact that the slurry is easier to transport through the blast hose (the liquid acting as a lubricant) with less drag, thus keeping the speed of each particle higher than in a dry system or a system that injects water at the nozzle. The higher speed of each particle results in a higher momentum factor for the wet abrasive blast design as compared with a dry system that injects water at the final stage at the nozzle. Testing has proven that the identical blast hose and nozzle combination lasts up to 5 times longer in a wet-abrasive blast system as compared with a dry system, thus supporting the lubrication factor.

As described earlier, the pressurized blast pot (pressure maintained by a fluid pump in a system from which substantially all of the air has been vented) is just one component in the wet abrasive blasting system, the purpose of which is to create positive flow of slurry through the mixer and into the air stream. Obviously, once the air-controlled slurry shut-off valve is opened, the pressure in the pot and the pressure in the airstream will attempt to equalize. Typically, a higher pressure in the blast pot than the pressure in the air stream is due to the resistance of the slurry and the setting of the fluid pump, which provides consistent positive flow of slurry to the mixer. In certain embodiments, the fluid pump's pressure output regulator may be set at least 15~20 psi higher than the intended blast pressure. Testing has shown that as long as the pressure in the blast pot is maintained at or above the blast pressure, the slurry is forced into the air stream rather than air being forced backwards toward the blast pot. The pressure in the blast pot (once initially set) may be maintained by an adjustable flow-control valve (metering valve). The setting of this valve predictably controls the volume of slurry being forced into the air stream. As this valve injects fluid into the pot (using pressurized fluid from the fluid pump), the same amount of slurry is forced into the air stream based on the principle that the fluid in the pot cannot be compressed and, therefore, additional fluid forced into the pot must equal the same volume of slurry forced out of the pot.

A fluid control circuit diverts flow of fluid to various locations in the wet abrasive blasting system to perform various operations. In a specific embodiment, the fluid control circuit needs to provide at least eight functions in order to accomplish an easy, yet efficient wet abrasive blasting system. The eight functions may be:

1. Fill and Pressurize the blast pot with fluid ("Fill");
2. Maintain Pressure in the pot during blasting operation ("Blast");
3. Wash down ("Wash Down") blasted substrate through blast nozzle without abrasive in the mixture (after blasting);
4. Blow down ("Blow Down") of blasted substrate with compressed gas;
5. Rinse ("Rinse") with use of rinse hose;
6. Dilute clogged abrasive in abrasive hose from pot to mixer ("Flush");
7. Flush internal plumbing ("Fill/Flush" with abrasive hose ball valve closed and quick coupler disconnected);
8. Final flush to expel any unspent media from the internal plumbing and the blast pot ("Fill/Flush" with abrasive hose ball valve open).

Figure 2:
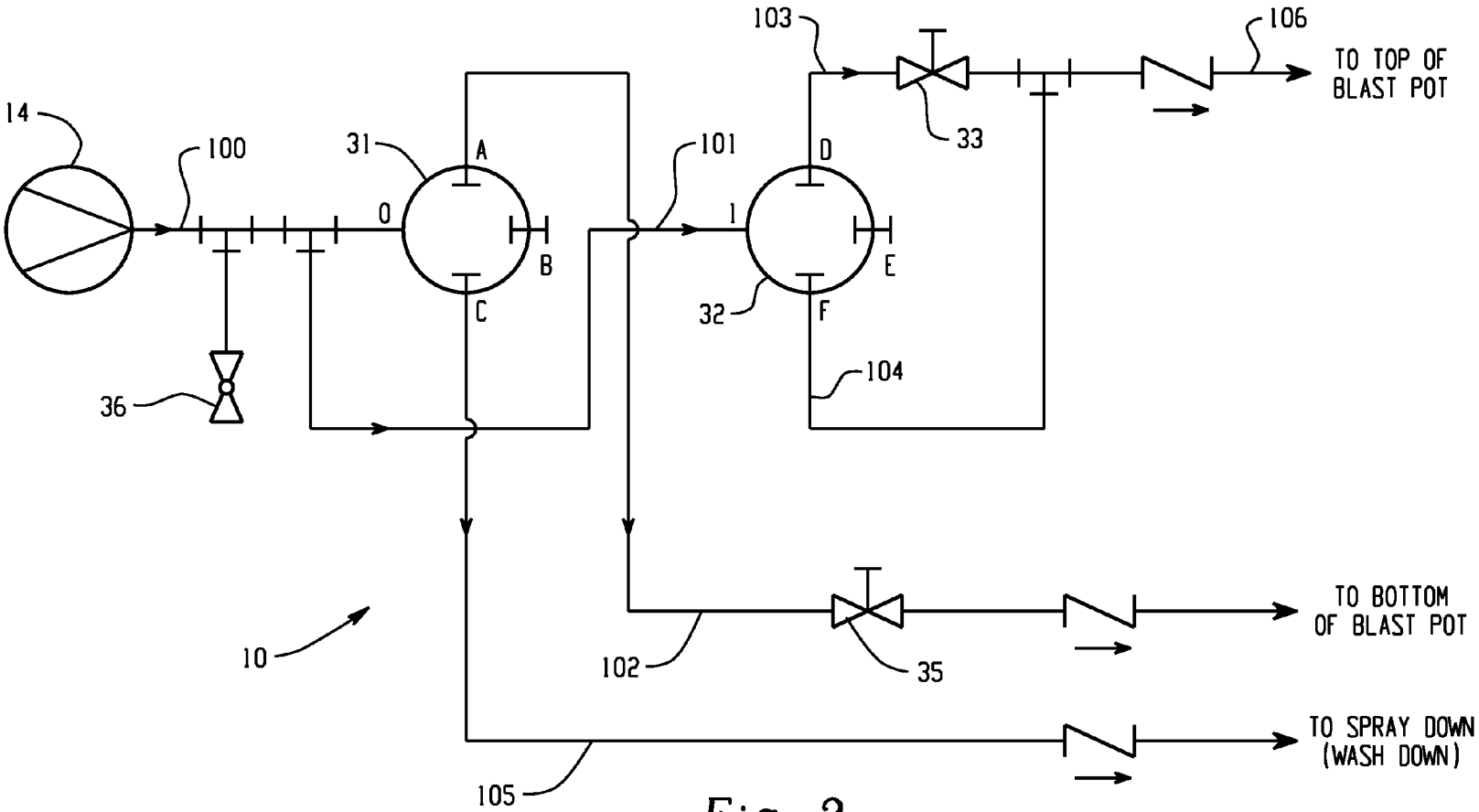
Fig. 2 PRIOR ART
FIG. 2 is a schematic drawing of a prior art fluid control circuit of a wet abrasive blasting system.

The prior art system's fluid control circuit, used on conventional wet abrasive blasting systems, is shown in FIG. 2. The prior art system comprises two, three-way valves or selector valves. Each three-way ball valve or selector valve has an inlet connected to the source of pressurized fluid such as, in the embodiment shown in FIG. 2, a fluid supply pump 14. The fluid supply pump 14 is in fluid communication with the first selector valve 31 by fluid piping 100 and with the second selector valve 32 by fluid piping 100 and 101. Each selector valves 31 and 32 has three positions creating fluid communication with the three outlets of the selector. The first selector valve comprises outlet A in fluid communication with the bottom of the blast pot outlet B which is blocked, and outlet C in fluid communication with the slurry piping between the manual ball valve and the diaphragm valve (both not shown in FIG. 2, but shown in FIG. 1). The second selector valve 32 comprises outlet D in fluid communication through a metering valve or flow control valve 33 with the top of the blast pot outlet E which is blocked and outlet F in fluid communication with the top of the blast pot beyond the metering valve.

The first piping system 102 may be considered to be in fluid communication with the bottom of the blast pot 11 if the first piping system 102 is connected to the slurry piping system 15 at the bottom of the blast pot 11 or other location wherein fluid may flow to the conical bottom 12 of the blast pot 11. To perform the Fill and Pressurize step (No. 1) on a conventional wet abrasive blast unit, the first selector valve should be set to B, and the second selector valve should be set to F so that the fluid flow goes directly to the top of the pot without going through the metering valve.

To perform the Blast step (No. 2) on the conventional wet abrasive blast unit, the first selector valve should be set on B and the second selector valve set on D so the fluid flow to the top of the blast pot may be controlled with the metering valve.

To perform the Wash Down step (No. 3) on the conventional wet abrasive blast unit, the abrasive hose ball valve 17 (shown in FIG. 1) must be closed, the first selector valve 31 should be set on C and the second selector valve 32 set on E so the fluid flows directly into the slurry line between the abrasive hose ball valve 17 and the diaphragm valve 18 (shown in FIG. 1) to be propelled by the compressed gas through the blast hose and nozzle as a fluid/gas mixture, without any abrasive.

To perform the Blow Down step (No. 4) on the conventional wet abrasive blast unit, the first selector valve should be set on B and the second selector valve set on E, and the abrasive ball valve 17 (illustrated in FIG. 1) closed, so that the fluid and abrasive flow is stopped, leaving only gas propelled through the blast hose and nozzle.

To perform the Rinse step (No. 5) on the conventional wet abrasive blast unit, the first selector valve should be set on B and the second selector valve set on E and the Rinse valve 36 set to open. This provides fluid at the full volume of the fluid pump to aid in clean up or to help wash the media into the pot during initial setup.

To perform the Dilute clogged abrasive step (No. 6) on the conventional wet abrasive blast unit, the first selector valve should be set on A and the second selector valve set on E and the metering valve 35 opened fully to allow fluid to be injected into the abrasive hose at the bottom of the pot. This serves to dilute any clogging of the media that may occur if the unit sits idle for too long of a period.

To perform the Flush Internal Plumbing step (No. 7) on the conventional wet abrasive blast unit, the abrasive hose ball valve 17 (illustrated in FIG. 1) should be closed so that the abrasive hose's quick coupler can be disconnected safely. The first selector is set on C and the second selector is set on E. This will cause media inside the internal plumbing (below the diaphragm valve) to be flushed out of the opened quick coupler.

To perform the Final Flush step (No. 8) on the conventional wet abrasive blast unit, the first selector valve should be set on A and the metering valve 35 should be fully opened. The second selector valve set on F so the fluid flows directly to the top of the blast pot. With the abrasive ball valve closed, the quick coupler can be safely opened. The disconnected abrasive hose can now be flushed clean by opening the abrasive hose ball valve.

The complexity of the steps and ability to set the selector valves in positions that do not perform a particular function demonstrates the problems with the design and configuration of the conventional fluid control circuits and fluid piping of conventional wet blasting systems. These problems result in possible operator error due to all of the possible combinations of positions presented by two or more selector valves and metering valves. The selection of each process is complicated by having to set each selector valve in the correct position and if the selector valves are not turned in the correct position the desired operation may not be accomplished or accomplished inefficiently. As previously stated, both the first selector valve and the second selector valve are connected to the source of pressurized fluid through a common piece of piping. During a Blast operation, the user could incorrectly set the first selector valve to A and the second selector valve to D simultaneously. This directs fluid through the "Abrasive Metering valve" to the top of the blast pot and also through the "Water Metering valve" to the bottom of the blast pot. The blasting may appear to be operating normally, but additional fluid is being added at the bottom of the blast pot, diluting the slurry. This produces an inefficient blasting operation that is, unfortunately, difficult to notice, especially for inexperienced operators.

The fluid control system described herein as new technology eliminates this combination possibility. The inventor determined that many users were setting the prior art blast equipment to this combination of A and D (some intentionally) and flooding the blast (media to fluid ratio), thus using too much media and consuming too much fluid and causing "run-off"—a major issue in some states, especially California. Depending on the proximity to storm drains or natural water ways, this could also become a pollution issue.

In the same manner, the user could mistakenly select C and F simultaneously setting the selector valves to Fill and Wash Down at the same time while intending to be in Blast mode. This would totally bypass both metering valves and result in a very inefficient and uncontrolled wet abrasive blasting system. The water control system and selector valve positioning of conventional wet abrasive systems are not intuitive and can prove to be difficult to set correctly for inexperienced operators.

Often the two major mistakes users perform, described above, result in inefficient wet abrasive blasting operations, and the benefits of the wet abrasive system are defeated. The inventor devised an easier to use and operate system, which greatly reduces the opportunity for operator error. This innovation allows an inexperienced operator such as, for example, a person merely renting a system with little training in wet abrasive blasting, to operate the machine almost as effectively as an experienced operator.

For example, the inventor realized that for conventional wet blasting systems, service calls are generally due to operator error in setting up the fluid configuration system, and not due to problems with the wet abrasive blasting system. These problems are not because there are failures of components in the wet abrasive blasting system. Typically they are due to operator confusion concerning the correct combination of positions or settings of two or more selector valves and two or more metering valves utilized on conventional, prior art wet abrasive blasting systems.

For example, at certain times (i.e. after a prolonged idle period on a very hot day), the slurry flow may be diminished or completely stopped, resulting in only air exiting the blast hose. Should such a situation exist, this invention has added an additional function to the fluid control system called the "Flush" function. This function can be activated by simply turning the selector valve to the indicated position (without the need for any other adjustment, such as changing the setting of a metering valve). Returning the selector to the "Blast" position, after the situation has been resolved, results with reduced possibility of an operator error because no other adjustment or setting needed to be changed and the metering valve remains how it was previously set. This is not the case in conventional prior art wet blasting systems.

Embodiments of the fluid control circuit for the wet abrasive blasting system described herein provide a smooth, consistent, predictable, and controlled flow of slurry and produce far less chance of operator error than conventional wet abrasive systems. Thus, the wet abrasive blasting system is safer and more efficient to use (both for the operator and the environment).

An embodiment of the fluid control system is shown in FIG. 3. The fluid control system has one selector valve 33. In this embodiment, the selector valve 33 is a four way valve comprising one inlet G for the source of pressurized fluid and four fluid outlets (H, I, J, K). In the embodiment shown in FIG. 3, only one of the outlets H, I, J, and K may be selected at any time. The four outlets are as follows:

1. Outlet H (first fluid outlet) is used in the Fill/Flush step and is in fluid communication with both the top inlet of the blast pot and the bottom inlet of the blast pot. Specifically, this is done through first piping system 102 to the bottom of the blast pot and through jumper piping 107 by opening check valve 36 and second piping system 106 to the top of the blast pot. The blast pot is filled from the top and bottom inlets in this mode, preventing dry media from clogging the abrasive hose at the bottom of the pot.

2. Outlet I (second fluid outlet) is used in the Blast step and is in fluid communication with the top of the blast pot through the second piping system 106 and the metering valve 37. As discussed previously, efficient operation of the wet abrasive blasting process is performed when the fluid enters at the top of the blast pot and exits through the bottom nozzle with the entrained abrasive. In the embodiment of the wet abrasive blasting system shown in FIG. 3, fluid will not flow through the jumper piping 107 with the selector valve 33 in communication with outlet I (second fluid outlet) because the check valve 36 will remain closed. The jumper piping system 107 comprises a check valve 36 that allows fluid flow from first piping system 102 to second piping system 107 and jumper piping system 106 so that outlet H is in fluid communication with both the top and the bottom of the blast pot 11, however, check valve 36 does not allow flow from piping system 106 to piping system 102, therefore, outlet I is not in fluid communication with the bottom of the blast pot but is only in fluid communication with the top of the blast pot 11 through the metering valve 37.

The four way valve (selector valve 33 in FIG. 3), jumper piping 107 and check valve 36 eliminate the need for the second selector valve of the prior art conventional system of FIG. 2. An embodiment of a fluid control system for a wet abrasive blasting system comprises a selector valve 33 with a first fluid outlet H in fluid communication with a first piping system 102 to the bottom of a blast pot 11, a second fluid outlet I in fluid communication with a second piping system 106 to the top of a blast pot 11, and jumper piping system 107 between the first piping system 102 and the second piping system 106. In a particular embodiment, the jumper piping system 107 comprises a check valve 36 that prevents fluid flow from the second piping system 106 to the first piping system 102 but allows fluid flow from the first piping system 102 to the second piping system 106.

3. Outlet J is connected to a bypass piping system 108 to bypass the blast pot 11 and direct fluid into the top of the slurry piping system, without abrasive, and then into the blast hose 26 and nozzle 27 providing a pressurized wash down feature.

4. Outlet K is in fluid communication with a rinse piping system including a rinse ball valve 109 and rinse hose (not shown). The rinse piping system 109 bypasses the wet abrasive blasting system to aid in loading the media into the blast pot 11 and to allow general cleanup of the equipment and the blasting area.

Figure 4:
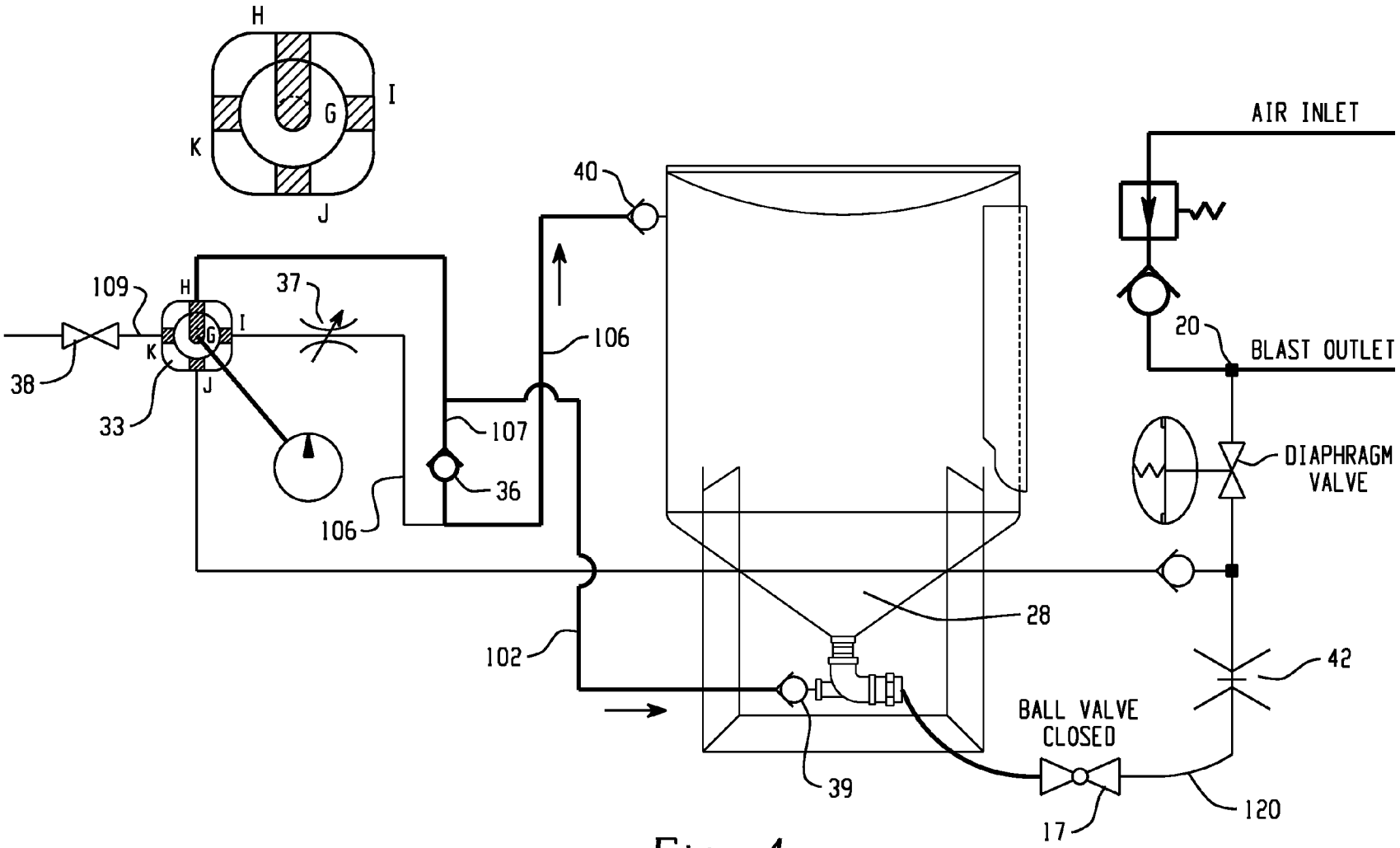
FIG. 4 is a schematic of an embodiment of a fluid control circuit of a wet abrasive blasting system illustrating the fluid flow in Fill/Flush mode to fill and pressurize the pot.

As previously mentioned, the blast pot should be substantially purged of the air from within to reduce an accumulator effect caused by compression and expansion of trapped air. In one embodiment of the wet abrasive blast system, the air from the blast pot is vented during filling of the blast pot with fluid through an automatic air-purging vent. The air may be substantially vented during the fill step with the selector set on the "Fill/Flush" function of the selector valve. A schematic of an embodiment of the fluid control circuit of a wet abrasive blast system in Fill/Flush mode is shown in FIG. 4. The piping systems in fluid communication with the fluid inlet of selector valve 33 an the air supply piping are shown in bolt. A ball valve 17, installed between the outlet 28 of the blast pot 11 and the inlet of the mixing tee 20, is closed to prevent flow of slurry to the mixing tee 20 during this operation.

The blast pot 11 is filled and pressurized by the fluid pump's flow being directed through the selector valve inlet G in fluid communication with outlet H. The fluid flows to the Lower Pot Check Valve 39 and also to the Upper Pot Check Valve 40 through the jumper piping system 107 by opening the Fluid Circuit Check Valve 36. This action pressurizes the blast pot 11 in preparation for blasting.

Figure 5:
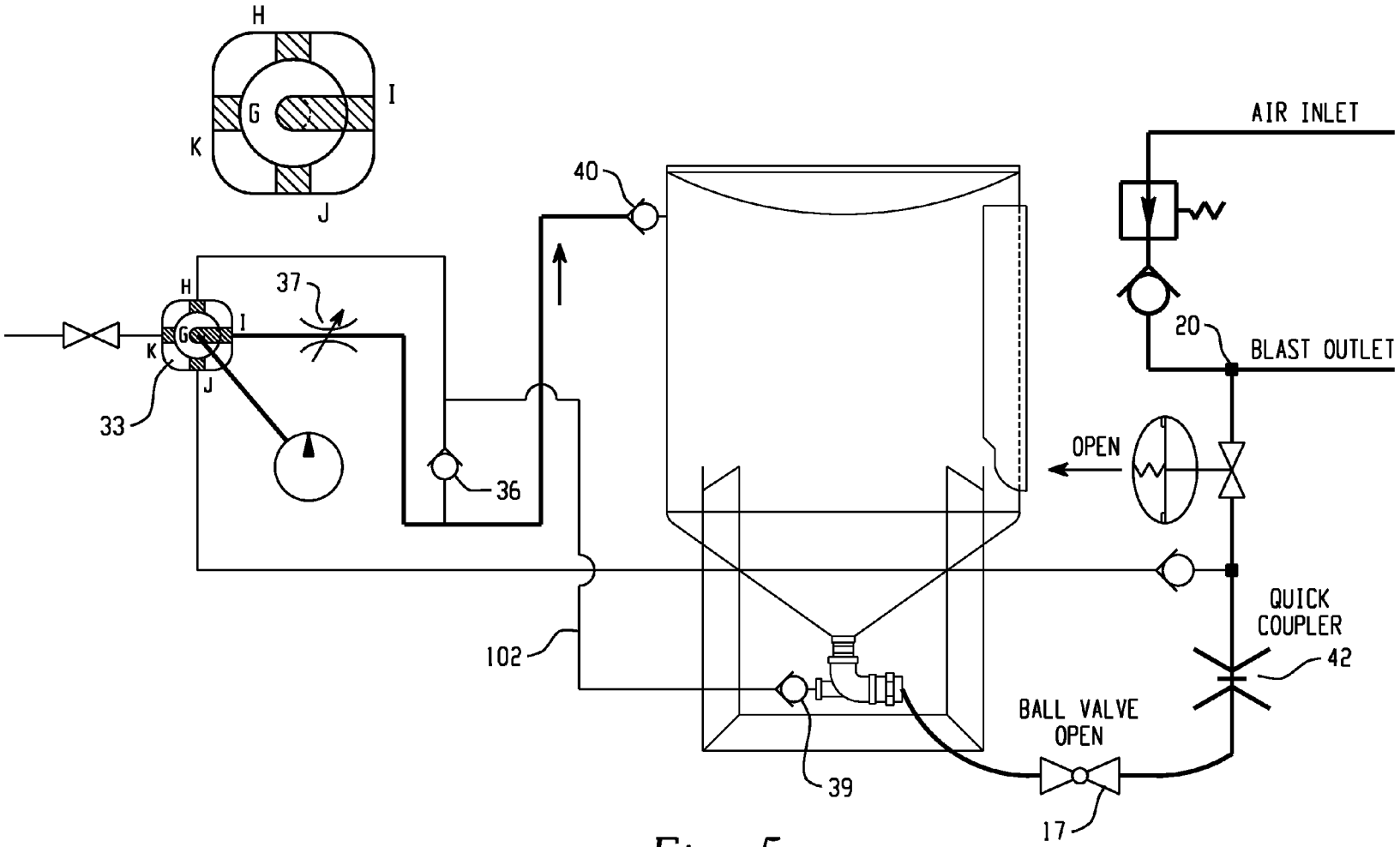
FIG. 5 is a schematic of an embodiment of a fluid control circuit of a wet abrasive blasting system illustrating the fluid flow in Blast mode.

When the selector valve 33 is turned to the "Blast" function and the abrasive ball valve 17 is opened, the fluid pump's flow is directed through the selector valve inlet G to outlet I and through the metering valve 37 and through the Upper Pot Check Valve 40 to maintain pressure and, when desired, flow to the top of the blast pot for blasting. The fluid cannot open the Fluid Circuit Check Valve 36 to flow into the blast pot's lower check valve 39 due to the orientation of the Fluid Circuit Check valve 36. This provides metered control over the volume of wet abrasive that will be forced into the air stream because the existing volume of media and fluid in the blast pot 11 cannot be compressed. Therefore, any additional fluid forced into the top of the blast pot 11 must result in the same volume of wet media being forced out of the bottom of the blast pot 11. A schematic of an embodiment of the fluid control circuit of a wet abrasive blast system in Blast mode is shown in FIG. 5. The piping systems in fluid communication with the fluid inlet of selector valve 33 and the air supply piping are shown in bold.

Figure 6:
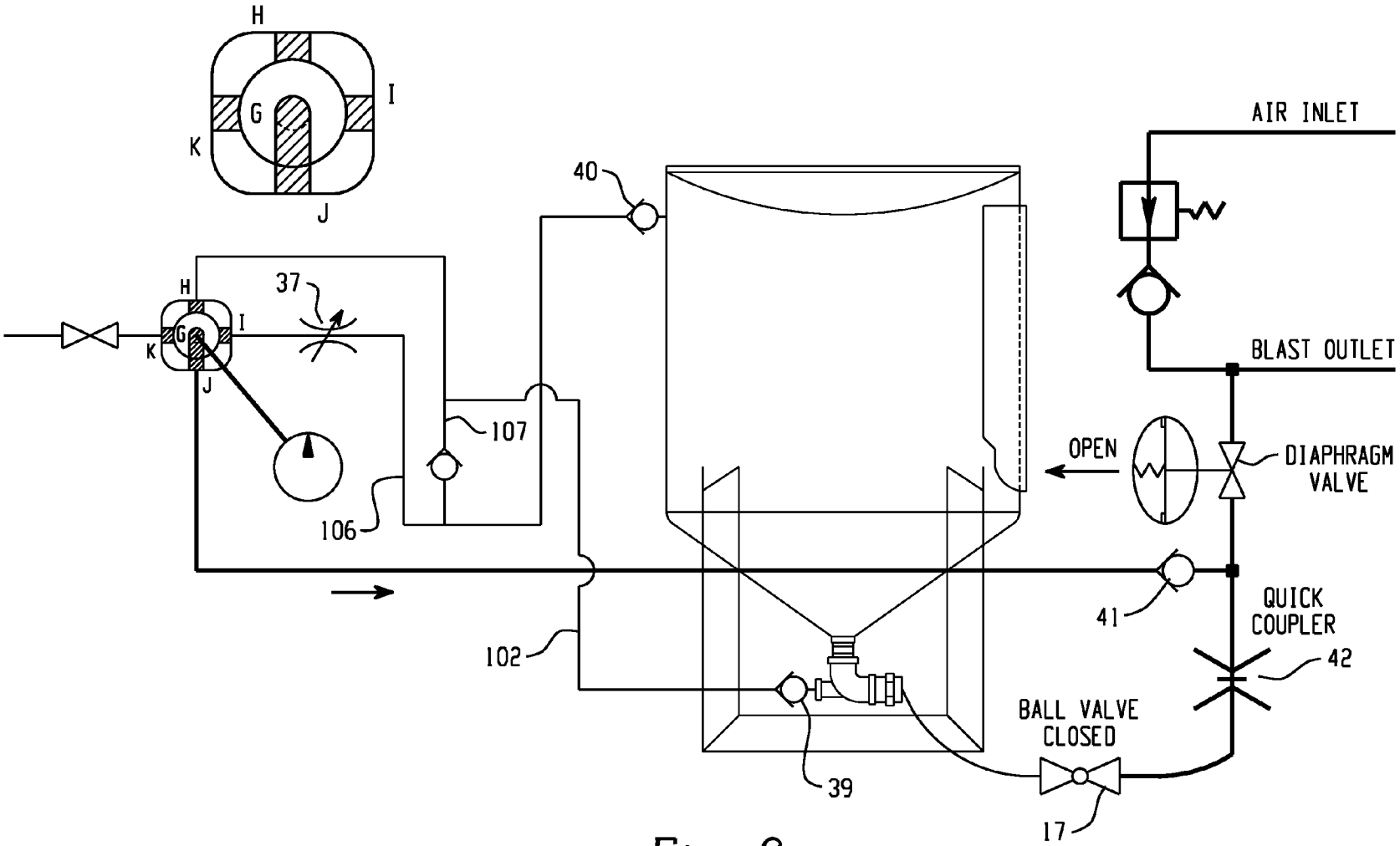
FIG. 6 is a schematic of an embodiment of a fluid control circuit of a wet abrasive blasting system illustrating the fluid flow in Wash Down mode.

After blasting has been performed, it may be desirable to pressure-wash the blasted surface. This can be accomplished with the abrasive ball valve 37 closed and turning the selector valve to outlet J for "Wash Down" mode. In this position, the fluid pump's flow is directed through the selector valve G to outlet J and then through the Wash Down Check Valve 41. This forces fluid, without additional abrasive, into the piping that carries slurry during blasting. The fluid, without abrasive media, is fixed into the compressed air stream and serves as a power wash through the blast hose. A schematic of an embodiment of the fluid control circuit of a wet abrasive blast system in Wash Down mode is shown in FIG. 6. The piping systems in fluid communication with the fluid inlet of selector valve 33 and the air supply piping are shown in bold.

Figure 7:
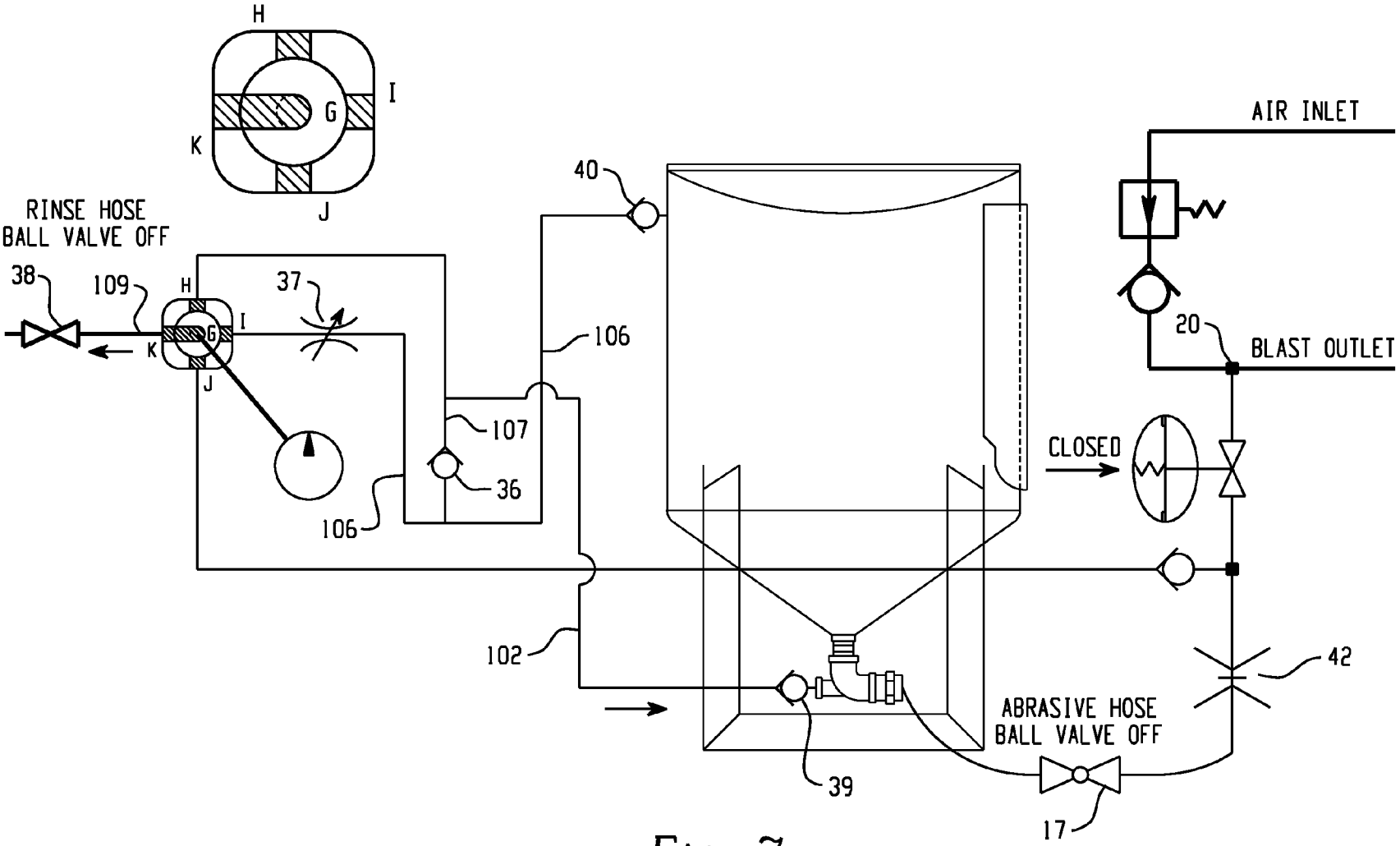
FIG. 7 is a schematic of an embodiment of a fluid control circuit of a wet abrasive blasting system illustrating the fluid flow in Rinse/Off mode.

After washing down the blasted surface it may be desirable to blow down the surface with air to aid in drying the surface. This is accomplished by turning the selector valve 33 into the "Rinse/Off" mode. In this mode, the fluid pump's flow is directed through the selector valve G to outlet K but then it is blocked because the rinse ball valve is closed. The slurry is also blocked by the abrasive hose ball valve 17 in the off position. This will allow only compressed air to pass through the blast hose. A schematic of an embodiment of the fluid control circuit of a wet abrasive blast system in Rinse/Off mode is shown in FIG. 7. The piping systems in fluid communication with the fluid inlet of selector valve 33 and the air supply piping are shown in bold.

Using the "Rinse/Off" function, it may be desirable to have access to the water pump's flow for washing off the machinery or aiding in washing the media into the blast pot during initial setup. The fluid pump's flow, through the selector valve inlet G to outlet K, is controlled by opening the rinse ball valve 38 to allow fluid to flow through a rinse hose attached to the rinse piping system 109.

As mentioned earlier, in certain circumstances, such as using ultra-fine abrasives (smaller than 120 grit) or when the equipment has been sitting idle for long periods of time (especially in hot weather), the abrasive flow through the abrasive hose 120 to the mixer 20 could become too slow or stopped. In such a circumstance, the "Fill/Flush" function will cause the fluid pump's flow to be directed through the selector valve inlet G to outlet H and then through the Fluid Circuit Check Valve 36 and then through the blast pot's top check valve 40 and bottom check valve 39, thereby introducing fluid, at the initial pot pressure setting, to dilute the clogged abrasive and allow the abrasive media to begin flowing again. When the clog has been cleared the fluid control circuit is set back to Blast Mode.

Figure 8:
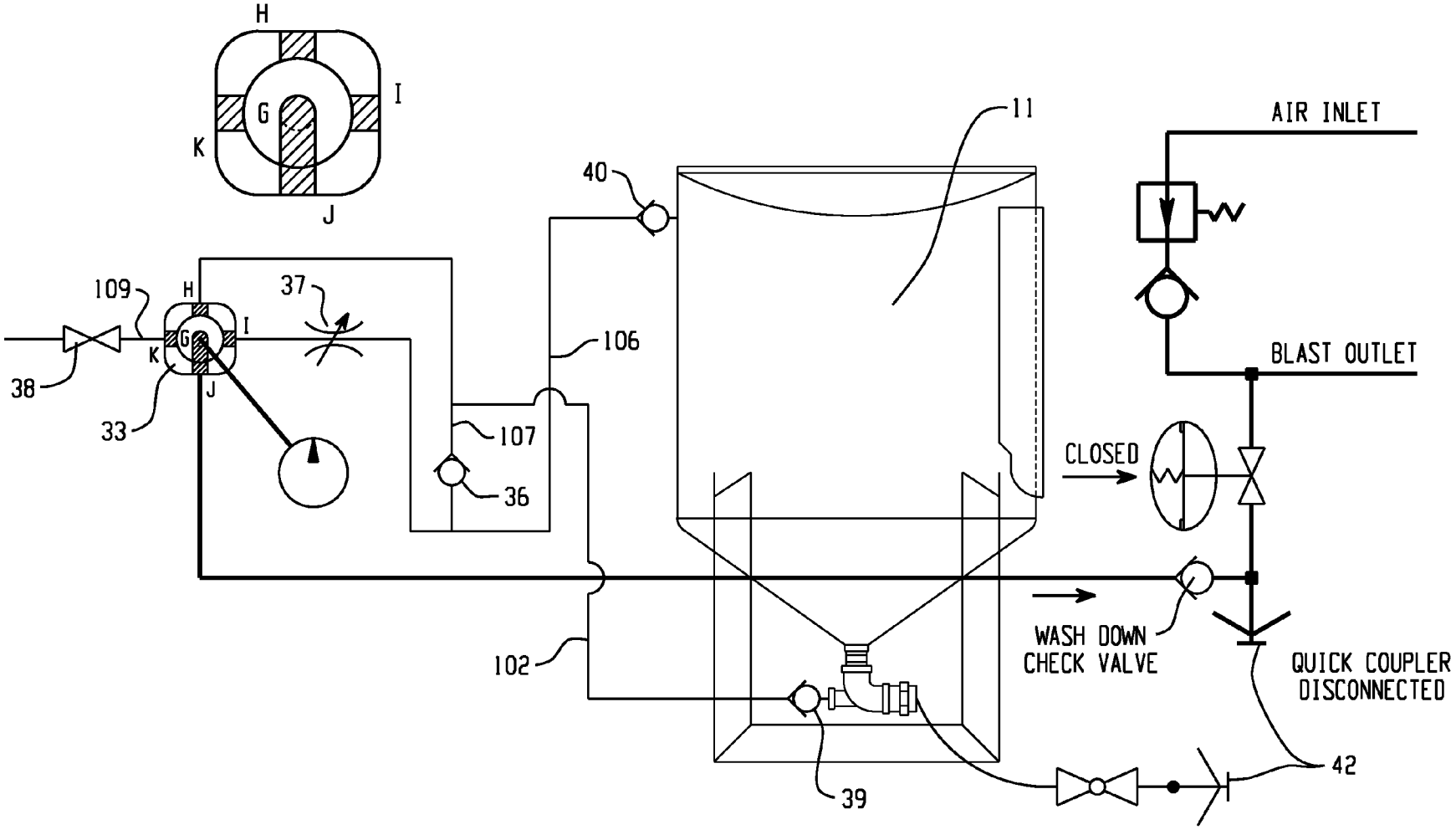
FIG. 8 is a schematic of an embodiment of a fluid control circuit of a wet abrasive blasting system illustrating the fluid flow in Wash Down Mode to Flush Abrasive from Internal Plumbing.

Finally, at the end of the shift or job, it may be prudent to expel all of the unspent media from the certain piping and from the blast pot 11. This is accomplished by first turning the abrasive ball valve 17 into the closed position, so one can safely uncouple the Quick Coupler 42. A catch bucket may be positioned under the open piping and the selector valve 33 set to the Wash Down position allowing the fluid pump's flow to be directed through the selector valve inlet G to outlet J and then through the wash down check valve 41. This will wash all of the media, still inside the slurry piping system 106, out through the open quick coupler 42. A schematic of an embodiment of the fluid control circuit of a wet abrasive blast system in Flush Piping mode, to expel media from the piping and hose, is shown in FIG. 8. The piping systems in fluid communication with the fluid inlet of selector valve 33 and the air supply piping are shown in bold.

Figure 9:
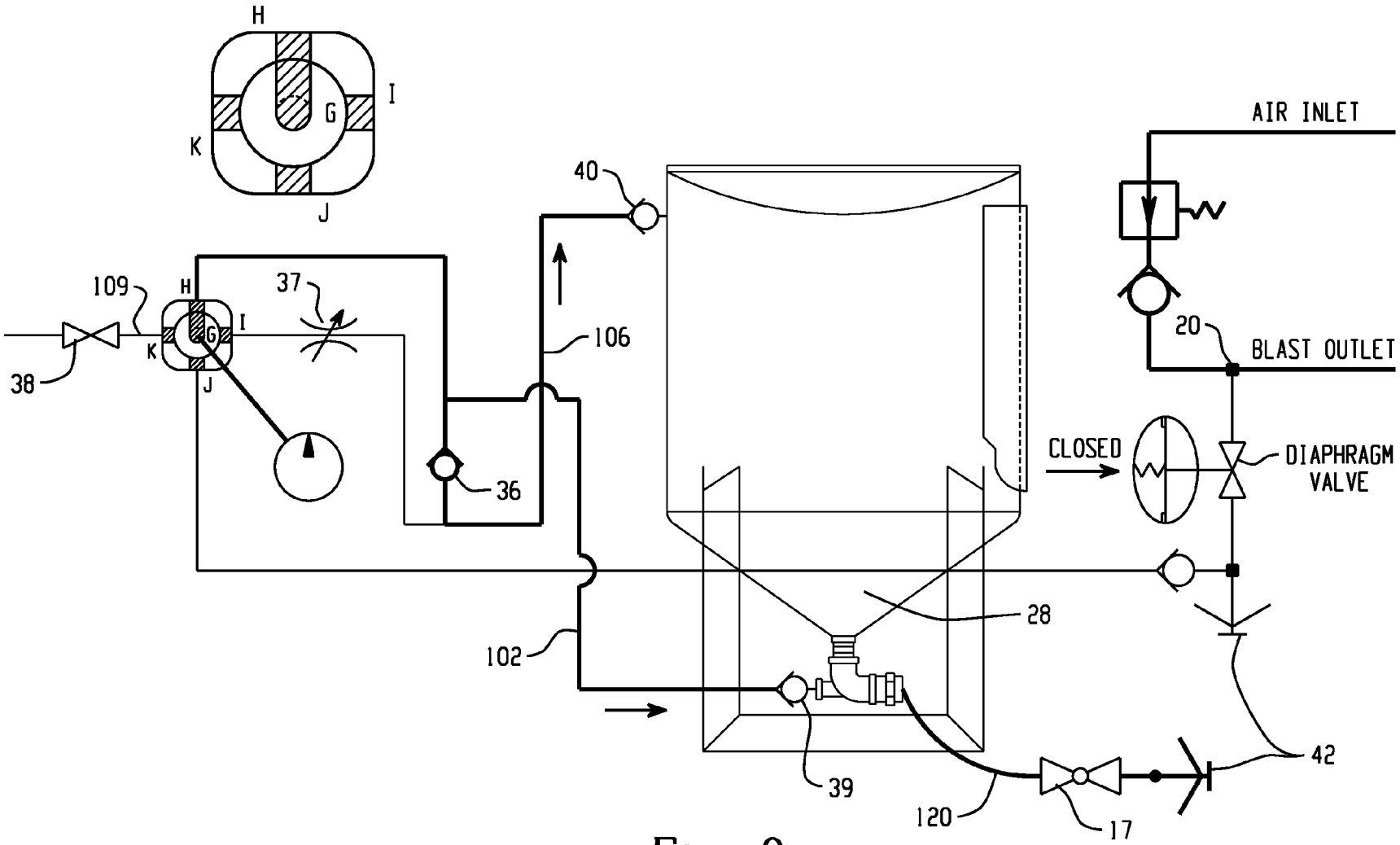
FIG. 9 is a schematic of an embodiment of a fluid control circuit of a wet abrasive blasting system illustrating the fluid flow in Fill/Flush Mode to Expel Media from Pot.

By turning the selector valve 33 to the "Fill/Flush" position, the fluid pump's flow will be directed through the selector valve inlet G to outlet H and then through the Fluid Circuit Check Valve 36 and through the pot's top check valve 40 and the bottom check valve 39. This will introduce fluid, at the initial pot pressure setting, which will push down like a piston on the media inside the pot and which will also be injected into the clean-out tee at the bottom of the pot. This in turn will dilute the media in the abrasive hose 120 and cause it to flow out through the open quick coupler 42 (controlled by the abrasive hose ball valve 17). A schematic of an embodiment of the fluid control circuit of a wet abrasive blast system in Final Flush mode to expel media from the blast pot 11 is shown in FIG. 9. The piping systems in fluid communication with the fluid inlet of selector valve 33 and the air supply piping are shown in bold.

The embodiments of the described fluid control circuits and wet abrasive blasting systems are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A fluid control circuit for a wet abrasive blasting system, comprising:

a blast pot comprising a top and a bottom;

a multiport selector valve comprising a fluid inlet (G), a first fluid outlet (H), and a second fluid outlet (I);

a first piping system (102) in fluid communication with the first fluid outlet (H);

a second piping system (106) in fluid communication with the second fluid outlet (I); and a jumper piping system (107) between the first piping system (102) and the second piping system (106), wherein the first piping system (102) provides fluid communication between the first fluid outlet (H) and the bottom of the blast pot and the second piping system (106) provides fluid communication between the second fluid outlet (I) and the top of the blast pot.

2. The fluid control circuit for a wet abrasive blasting system of claim 1, wherein the jumper piping comprises a check valve (36).

3. The fluid control circuit for a wet abrasive blasting system of claim 2, wherein the check valve (36) prevents flow from the second piping system (106) to the first piping system (102) but allows flow from the first piping system (102) to the second piping system (106).

4. The fluid control circuit for a wet abrasive blasting system of claim 1, wherein the second piping system (106) is in communication with the top of the blast pot and comprises a metering valve (37).

5. The fluid control circuit for a wet abrasive blasting system of claim 1, comprising only one selector valve (33).

6. A fluid control circuit for a wet abrasive blasting system, comprising a multiport selector valve comprising a fluid inlet (G), a first fluid outlet (H), a second fluid outlet (I) and a third fluid outlet;

a first piping system (102) in fluid communication with the first fluid outlet (H);

a second piping system (106) in fluid communication with the second fluid outlet (I); and a jumper piping system (107) between the first piping system (102) and the second piping system (106);

a third piping system in fluid communication with the third fluid outlet, wherein the third fluid outlet (J) prevents fluid flow from the fluid inlet (G) to any of the first piping system (102), the second piping system (106) and a fourth piping system (K), and the third fluid outlet provides fluid flow to a check valve in the third piping system.

7. A fluid control circuit for a wet abrasive blasting system comprising a multiport selector valve comprising a fluid inlet (G), a first fluid outlet (H), a second fluid outlet (I) and a fourth fluid outlet (K);

a first piping system (102) in fluid communication with the first fluid outlet (H);

a second piping system (106) in fluid communication with the second fluid outlet (I);

a jumper piping system (107) between the first piping system (102) and the second piping system (106); and wherein the fourth outlet (K) is in fluid communication with a fourth piping system in fluid communication with a rinse hose.

8. The fluid control circuit for a wet abrasive blasting system of claim 7, wherein the selector valve comprises the fluid inlet (G) and four fluid outlets (H, I, J, K).

9. A wet abrasive blasting system, comprising:

a blast pot, the blast pot comprising a top inlet and a bottom inlet;

a fluid control circuit, comprising a multiport selector valve comprising a fluid inlet, a first fluid outlet, and a second fluid outlet;

a source of pressurized fluid in fluid communication with the fluid inlet;

a first piping system in fluid communication with the first fluid outlet and the bottom pot inlet;

a second piping system in fluid communication with the second fluid outlet and the top pot inlet; and a jumper piping system between the first piping system and the second piping system, the jumper piping system comprising a first check valve.

10. The wet abrasive blasting system of claim 9, comprising a slurry piping system in fluid communication with a bottom outlet of the blast pot and a first inlet of a mixing tee.

11. The wet abrasive blasting system of claim 10, further comprising a source of pressurized gas in fluid communication with a second inlet of the mixing tee.

12. The wet abrasive blasting system of claim 11, further comprising a blast hose in fluid communication with an outlet of the mixing tee.

13. The wet abrasive blasting system of claim 9, wherein the second piping system comprises a metering valve and a second check valve.

14. The wet abrasive blasting system of claim 13, wherein the check valve prevents fluid flow from the blast pot into the multiport selector valve.

15. The wet abrasive blasting system of claim 14, wherein the first piping system comprises a third check valve.

16. The wet abrasive blasting system of claim 15, wherein the third check valve prevents fluid flow from the blast pot into the multiport selector valve.

17. The wet abrasive blasting system of claim 13, wherein the metering valve is an internally limited metering valve.

18. The wet abrasive blasting system of claim 9, further comprising a rinse circuit ball valve and rinse hose in fluid communication with a fourth outlet of the selector valve.

19. The wet abrasive blasting system of claim 9, comprising a slurry piping system, an abrasive hose ball valve in the slurry piping system and a quick disconnect in the slurry piping system.

20. The wet abrasive blasting system of claim 9, wherein the fluid inlet of the selector valve is selectively capable of being in fluid communication with only one fluid outlet at a time.

21. The wet abrasive blasting system of claim 9, wherein at least a portion of the first piping system and the second piping system is translucent to aid seeing the passage of winterizing fluid for cold weather storage.

* * * * *